United States Patent [19]

Ma et al.

[11] Patent Number: 4,785,302

[45] Date of Patent: Nov. 15, 1988

[54] AUTOMATIC POLARIZATION CONTROL SYSTEM FOR TVRO RECEIVERS

[75] Inventors: John Y. Ma, Milpitas; David H. McCracken, San Jose; Steven Weiss, Los Gatos; Albert C. Houston, III, Santa Cruz, all of Calif.

[73] Assignee: Capetronic (BSR) Ltd., Kowloon, Hong Kong

[21] Appl. No.: 792,780

[22] Filed: Oct. 30, 1985

[51] Int. Cl.[4] ..... H01Q 21/06

[52] U.S. Cl. ..... 342/362; 342/352; 342/358

[58] Field of Search ..... 342/352, 357, 358, 362, 342/75, 361, 363; 343/909, 754

[56] References Cited

U.S. PATENT DOCUMENTS

| | | | |
|---|---|---|---|
| 3,089,137 | 5/1963 | Pierce | 342/363 |
| 3,093,825 | 6/1963 | Allen | 342/363 |
| 3,311,916 | 3/1967 | Packard | 342/363 |
| 3,383,688 | 5/1968 | Renaudie | 342/352 |
| 3,523,294 | 8/1970 | Okamura et al. | 342/352 |
| 3,530,471 | 9/1970 | Mark | 342/352 |
| 3,772,701 | 11/1973 | Wilkinson | 342/359 |
| 3,842,420 | 10/1974 | Rabow | 342/75 |
| 3,890,571 | 6/1975 | Beyer | 343/703 |
| 4,030,099 | 6/1977 | Valenti et al. | 342/75 |
| 4,060,808 | 11/1977 | Foldes | 342/352 |
| 4,090,201 | 5/1978 | Whitman | 342/75 |
| 4,336,542 | 6/1982 | Bielli et al. | 342/362 |
| 4,358,767 | 11/1982 | Boireau | 342/352 |
| 4,418,350 | 11/1983 | Rosen | 342/352 |
| 4,504,836 | 3/1985 | Seavey | 343/761 |
| 4,542,326 | 9/1985 | Hornback | 342/75 |

OTHER PUBLICATIONS

Butts, "A Frequency Reuse K-Band 60-Foot Antenna System for the TDRSS Ground Segment," pp. 25.2.1-25.2.5, 6/80.

*Primary Examiner*—Theodore M. Blum
*Assistant Examiner*—David Cain
*Attorney, Agent, or Firm*—Stephen G. Rudisill

[57] ABSTRACT

In a TVRO earth station having an antenna for receiving incoming satellite signals and polarizing means associated with the antenna for adjusting the relative alignment of the antenna orientation and the polarization of the incoming signals, an automatic polarization control system comprising means for producing an electrical control signal for controlling the polarizing means to adjust the relative alignment, means for detecting the noise level in the satellite signals received by the antenna, and means responsive to the detected noise level for adjusting the control signal, and thereby adjusting the polarizing means, to minimize the detected noise level.

14 Claims, 3 Drawing Sheets

AUTOMATIC POLARIZATION CONTROL SYSTEM FOR TVRO RECEIVERS

BACKGROUND OF THE INVENTION

This invention relates generally to TVRO receivers for the reception of a wide range of satellite TV signals and, more particularly, to an automatic polarization adjustment system for automatically aligning an earth station antenna with the plane of polarization of the particular channel to which the TVRO receiver is tuned at any given time.

In a TVRO system, the satellite signals are received by an antenna (usually a paraboloidal dish) and converted to a lower "1st IF" frequency at the antenna site. This conversion may be effected by a down converter, which converts only a single channel to the 1st IF frequency, or a block converter, which converts all channels of a common polarity to a 1st IF block of frequencies ranging from 950 to 1450 MHz. This entire block of frequencies is then fed via coaxial cable to the receiver, which selects a particular channel for viewing and/or listening. In the receiver, the 1st IF signals are converted to a 2nd IF frequency range which traditionally has been centered at 70 MHz in most TVRO systems.

The signals transmitted by a satellite have a designated polarization determined by the mode of excitation at the transmitting antenna prior to propagation through space. For efficient reception, and maximum video and/or audio quality, the receiving antenna subsystem of the TVRO must be properly aligned with the polarization of the received signals.

To minimize interference among signals from satellite transponders using adjacent frequency bands, the signals from transponders using alternate 20-MHz frequency bands have a first polarization, e.g., horizontal, while the transponders using the intervening frequency bands have a polarization orthogonal to the first, e.g., vertical. The frequency-modulated signals transmitted in adjacent channels almost always overlap each other, and thus it is important to have the receiving antenna precisely aligned with the polarization of the desired channel in order to avoid interference from adjacent channels. The signals from local terrestrial microwave links also overlap the frequency bands of the satellite channels, and thus precise polarization alignment of the selected signals and the receiving antenna can also help reduce terrestrial interference (commonly referred to as "TI").

Furthermore, proper orientation of an earth station antenna for reception of polarized signals from one satellite does not mean that the same orientation will provide optimum reception from other satellites. There are numerous satellites in geostationary orbit today, and these satellites are azimuthally spaced from one another to avoid interference. Thus, as an earth station antenna is swept across the array of geostationary satellites, the polarization planes of the different satellites are slightly skewed relative to each other due to the azimuthal spacing of the satellites. As a result, the optimum plane of polarization of the earth-based antenna varies from satellite to satellite.

To properly align the antenna subsystem and the polarization plane of the incoming signals from any given satellite transponder, TVRO systems normally include polarizers which can adjust the relative alignment of the polarization of the incoming signals and the orientation of the antenna. One type of polarizer mechanically rotates the small probe that is included in the feedhorn of most earth station antennas, by means of a small servomotor which is powered by either the indoor receiver or an antenna positioner. A second type of polarizer adjusts the polarization of the incoming signal electronically, by changing the voltage applied to a coil wound around an electromagnetic ferrite core located at the throat of the feedhorn.

SUMMARY OF THE INVENTION

It is a primary object of the present invention to provide an improved TVRO receiver which automatically and reliably optimizes the relative alignment of the antenna orientation and the polarization of the particular satellite signal selected by the tuner.

Another object of this invention is to provide an improved TVRO receiver having an automatic polarization control system which can be used with either mechanical or electronic polarizers.

A further object of the invention is to provide such an improved TVRO receiver in which the automatic polarization control system does not require any manual intervention or data input by the user.

Still another object of the invention is to provide such an improved TVRO receiver in which the automatic polarization control system can be easily and economically incorporated in an otherwise standard receiver at a relatively low cost.

Other objects and advantages of the invention will be apparent from the following detailed description and accompanying drawings.

In accordance with the present invention, an automatic polarization control system is provided for a TVRO earth station having an antenna for receiving incoming satellite signals and polarizing means associated with the antenna for adjusting the relative alignment of the antenna orientation and the polarization of the incoming signals, the control system comprising means for producing an electrical control signal for controlling the polarizing means to adjust the relative alignment of the antenna and the signal polarization, means for detecting the noise level in the satellite signals received by the antenna, and means responsive to the detected noise level for adjusting the control signal, and thereby adjusting the polarizing means, to minimize the detected noise level.

In a particularly preferred embodiment, the control signal is adjusted through a predetermined range of values, thereby adjusting the polarizing means through a predetermined range of settings, and the control system includes means for determining the minimum noise level detected during the adjustments of the control signal and storing the control signal value corresponding to the minimum noise level.

BRIEF DESCRIPTION OF THE DRAWINGS

The invention and other objects and advantages thereof, may best be understood by referring to the following description in conjunction with the accompanying drawings, in which.

DESCRIPTION OF THE PREFERRED EMBODIMENTS

Although the invention will be described with respect to certain preferred embodiments, it will be understood that it not intended to limit the invention to those particular embodiments. On the contrary, it is intended to cover all alternatives, modifications and equivalent arrangements as may be included within the spirit and scope of the invention as defined by the appended claims.

Figure 1:
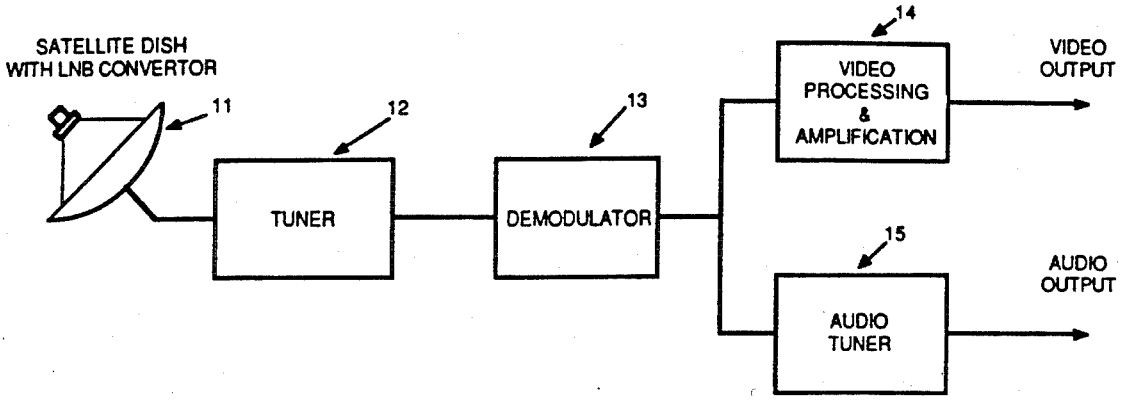
FIG. 1 is a functional block diagram of a conventional TVRO earth station.

Referring now to the drawings, in FIG. 1 there is shown a functional block diagram of a TVRO earth station for the reception of satellite signals. The system includes an antenna 11, which is typically a paraboloidal dish equipped with a low noise block (LNB) converter and related accessories and positioning mechanisms, for capturing signals transmitted from orbiting satellites; and a receiver system including a tuner 12, a demodulator 13, a video processing and amplification section 14, and an audio tuner 15.

The antenna 11 receives signals transmitted from the satellite in the 4-GHz frequency band (3.7 to 4.2 GHz), and this entire block of frequencies is converted to a 1st IF frequency range of 950 to 1450 MHz by the block converter located at the antenna site. The 1st IF signals are then sent via coaxial cable to the tuner 12 which selects a particular channel for viewing and converts the signals in that particular channel to a 2nd IF frequency range. The 2nd IF frequency range is preferably high enough to permit the 2nd IF VCO frequencies to be above the 1st IF block of frequencies, to prevent the VCO from interfering with the desired signals. For a 1st IF frequency range of 950 to 1450 MHz, this means that the center frequency of the second IF frequency range must be at least 500 MHz. A particularly preferred 2nd IF center frequency is 612 MHz.

Figure 2:
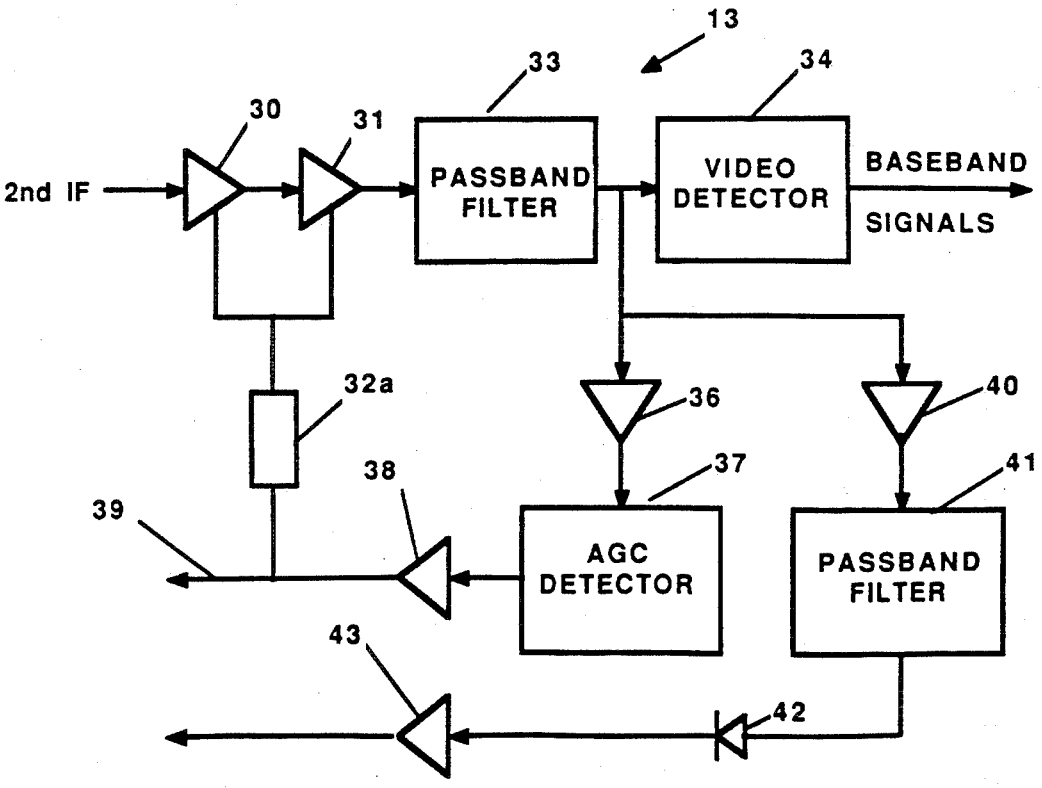
FIG. 2 is a diagram of a demodulator for use in the system of FIG. 1.

FIG. 2 is a block diagram of a demodulator 13 for receiving the 2nd IF output of the tuner 12 in the TVRO system of FIG. 1. This demodulator circuit includes a pair of conventional IF amplifiers 30 and 31 for receiving the 2nd IF signal from the final amplifier 25 in the tuner 12. Both of these amplifiers 30 and 31 receive an automatic gain control (AGC) signal via resistor 32. From the amplifier 31, the 2nd IF signal is passed through a filter 33 and on to a conventional video detector 34 which demodulates the frequency-modulated signal to the baseband of the original video signal (e.g., 0 to 10 MHz), producing a composite video output signal. The 2nd IF filter 33 preferably has a pass band that is only about 22 MHz wide; a pass band of this width passes the essential video and audio information while rejecting unwanted noise received by the antenna on the edges of the selected channel.

The AGC feedback loop includes an IF amplifier 36 which amplifies the output of the filter 33 and supplies it to an AGC detector 37. The output of this detector 37 is passed through an AGC amplifier 38, which produces a signal strength meter drive signal at a terminal 39. This signal strength meter is usually located on the front panel of the TVRO receiver.

The illustrative demodulator also includes an IF amplifier 40 which receives the same input supplied to the video detector 34, amplifies it, and passes it through a narrow passband filter 41. The output of the filter 41 is passed through a detector in the form of a diode 42. The signal passed by the diode 42 is smoothed by an amplifier 43 to produce a DC output voltage that can be used to detect the presence of a signal near the center frequency of the particular satellite channel to which the receiver is tuned. Although this signal is not used in the system of the present invention, it is useful to discriminate between satellite signals and TI.

The output of the demodulator illustrated in FIG. 2 comprises the baseband signals which range from DC to about 8.5 MHz; this includes video information from about 15 KHz to 4.2 MHz, and subcarriers from about 4.5 to 8.5 MHz. The video information in these baseband signals is passed through the video processing and amplification section 14 before being displayed on a video monitor or television set, and the audio signals are passed through an audio tuner and then on to one or more speakers which convert the signals to audible sound.

In accordance with one important aspect of the present invention, the polarizer is controlled by an automatic system comprising means for producing an electrical control signal for controlling the polarizer to adjust the relative alignment of the antenna orientation and the polarization of the incoming signals; means for detecting the noise level in the satellite signals received by the antenna; and means responsive to the detected noise level for adjusting the polarizer control signal, and thereby adjusting the polarizer, to minimize the detected noise level. The use of the noise level to adjust the polarizer control signal provides an extremely rapid response to the incoming signals.

Figure 3:
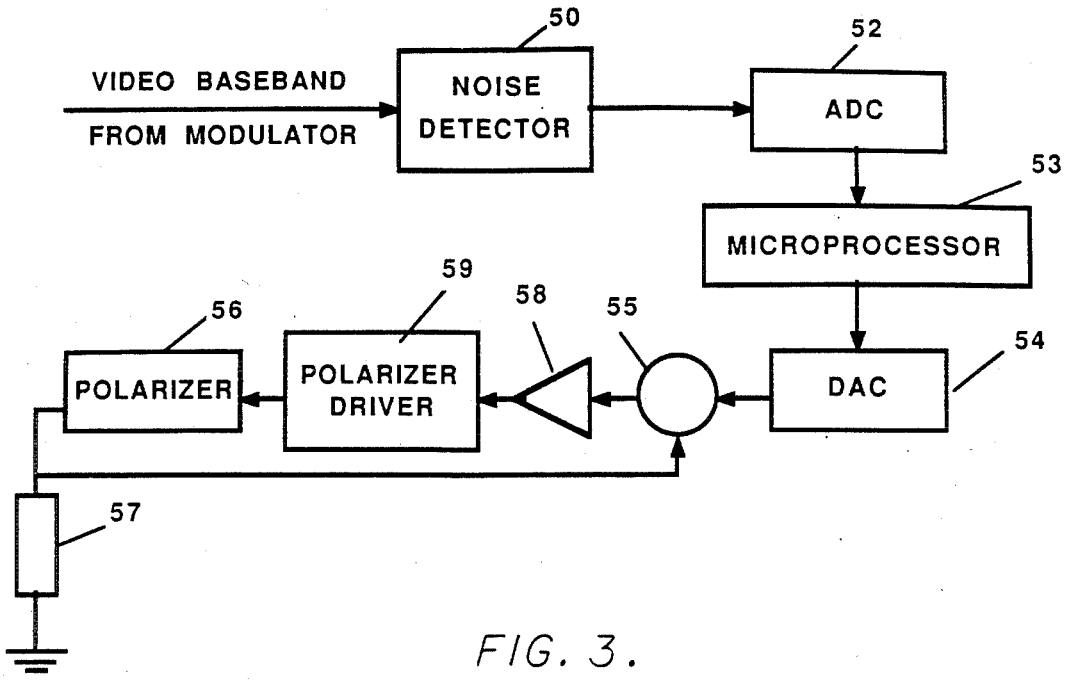
FIG. 3 is a simplified block diagram of an automatic polarization control system, embodying the present invention, for use in the system of FIG. 1.

In the illustrative embodiment of FIG. 3, the video output of the demodulator is fed to a noise detector 50 which produces a DC output whose magnitude is proportional to the noise level in the video baseband signal. This DC output is passed through an analog-to-digital converter (ADC) 52 to a microprocessor 53. Both the noise detector 50 and the program for controlling the microprocessor 53 will be described in more detail below in connection with FIGS. 5 and 6. The basic function of the microprocessor 53 is to produce an output signal that can be used to continually adjust the polarizer over a predetermined range, while at the same time evaluating the noise level detected at successive settings of the polarizer to determine the polarizer setting which produces the minimum noise level. This setting is then stored so that it can be retrieved to re-set the polarizer the next time the same channel is selected.

The microprocessor output signal for controlling the polarizer is supplied to a digital-to-analog (DAC) converter 54, whose analog output signal is applied to a summing junction 55. This signal represents the commanded voltage to be applied to the coil of a conventional ferrite-core polarizer 56. The other input signal to the summing junction 55 is a signal representing the actual setting of the polarizer, as determined by the current flow through a fixed resistor 57 connected between the polarizer coil and ground. The summing junction 55 algebraically sums these "command" and "actual" input signals, and produces a resulting "error" output signal proportional to any difference between the two input signals. Of course, whenever the microprocessor produces a signal intended to produce a change in the polarizer setting, there will be an immediate discrepancy between the "command" signal and the "actual" signal, thereby producing a deliberate "error" signal to change the setting of the polarizer 56.

The "error" output signal from the summing junction 55 is passed through an amplifier 58 to a polarizer driver circuit 59 which generates a DC voltage at the level required to set the polarizer 56 to the desired position represented by the "command" signal from the microprocessor 53. A number of different conventional circuits can be used for the driver 59, but it is preferred to use a two-stage, collector-output, current-limited Class B amplifier for this purpose.

As is well known, the ferrite-core polarizer 56 includes a wire coil wound around an electromagnetic ferrite core. The polarizer essentially acts as a controlling phase shifter and has a feed horn arrangement for accepting the incoming satellite signals and then passing them through the ferrite core. When a voltage is applied across the coil by the driver 59, an electromagnetic field of corresponding strength is set up around the ferrite core. This field interacts with the electromagnetic fields propagating through the core and rotates the plane of polarization of the received signals to a predetermined angle corresponding to the magnitude of the DC voltage applied to the coil by the driver 59.

Figure 4:
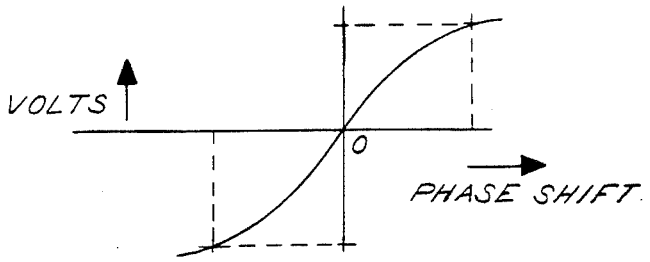
FIG. 4 is a graphical illustration of the polarization-rotating effect of a conventional ferrite polarizer.

The effect of changes in the DC voltage from the driver 59 on the operation of the polarizer 56 is illustrated in FIG. 4, which is a plot of the rotation of the signal polarization (in degrees) as a function of the DC voltage applied to the polarizer coil. As shown, zero voltage produces no phase shift, −18 volts rotates the signal 90° in one direction, and +18 volts rotates the signal 90° in the opposite direction. In actual ferrite-core polarizers which are commercially available, the ferrite core is usually saturated at plus or minus 14 volts, which corresponds to ±75° of signal rotation, so the total practical range of signal rotation is about 150°.

Figure 5:
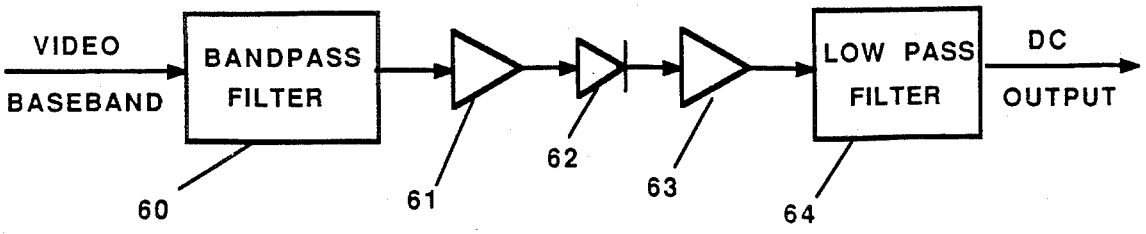
FIG. 5 is a diagram of a preferred noise detector for use in the system of FIG. 3.

The details of a preferred noise detector 50 are shown in FIG. 5. In this particular detector the video baseband signal from the demodulator 13 is initially fed through a bandpass filter 60 which preferably has a pass band that is about 500 KHz wide centered at about 23 MHz, which is well above the video information in the baseband signal. The 23-MHz center frequency also avoids interference from 27-MHz CB signals, 21-MHz and 24.5-MHz ham radio signals, and harmonics of the 4-MHz output of the crystal oscillator in the tuner 12.

The output of the bandpass filter 60 is passed through a conventional RF amplifier 61 to a detector in the form of a diode 62. This diode 62 rectifies the AC output from the amplifier 61, and the resulting signal is smoothed by passing it through a DC amplifier 63 and a low pass filter 64. It is the smooth DC output of the filter 64 that is applied to the ADC 52 in FIG. 3; as explained previously, the magnitude of this DC signal will vary in direct proportion to the noise level in the video baseband output from the demodulator.

Figure 6:
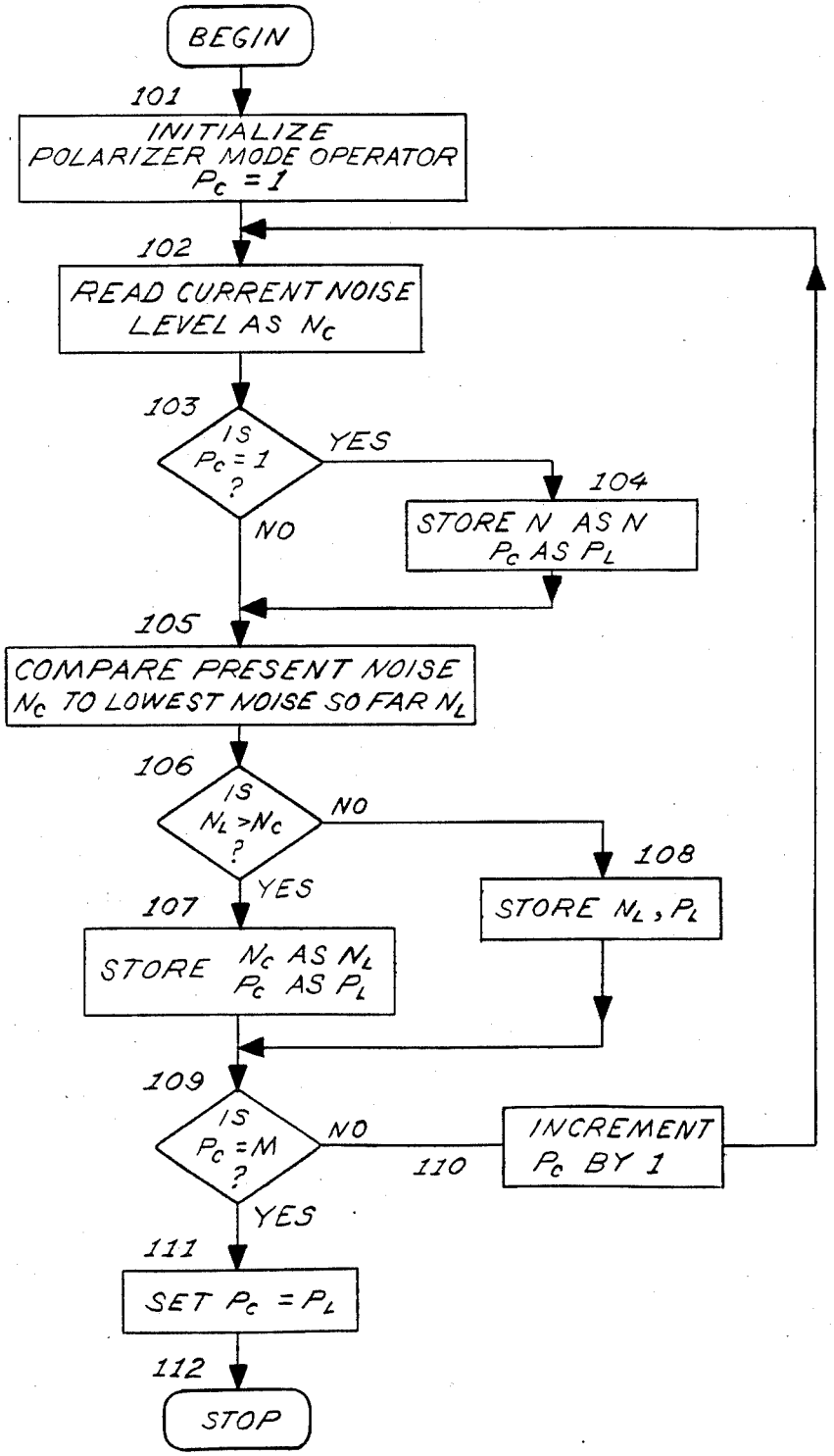
FIG. 6 is a flow chart of a program for controlling the microprocessor in the control system of FIG. 3 according to the invention.

FIG. 6 is a flow chart of a preferred program for controlling the microprocessor 53. This program is entered at step 101 where the current value $P_C$ of a polarizer mode operator is initialized to a current value of 1. This corresponds to a zero voltage level at the polarizer, which produces no phase shift.

At step 102, the current value $N_C$ of the DC output of the noise detector 50 is read to determine the noise level existing within the particular signal to which the tuner is currently tuned. Step 103 then checks whether the operator $P_C$ is at its initialized value, and if the answer is affirmative, the current values $N_C$ and $P_C$ of the noise level and the polarizer mode operator are stored at step 104 as values $N_L$ and $P_L$ representing, respectively, the lowest measured value of the noise level of the current signal, and the corresponding mode operator at which that noise level was measured.

At step 105, which is reached by a negative response at step 103 or following step 104, the values $N_C$ and $N_L$ are compared. If the current noise level value $N_C$ is found to be greater than the lowest previously measured noise value $N_L$, as determined at step 106, the lowest noise value $N_L$ and the corresponding polarizer mode operator value $P_L$ are restored at step 107. But if the current noise level value $N_C$ is found to be lower than the lowest noise value $N_C$, the current values $N_C$ and $P_C$ are stored as the new values $N_L$ and $P_L$ at step 108.

From step 107 or 108, the system advances to step 109 to determine whether the current value $P_C$ of the polarizer mode operator is equal to the maximum value M. An affirmative answer at this step indicates that the polarizer has been adjusted through its entire range of settings, and thus the currently stored value $P_C$ represents the polarizer setting that will produce the lowest noise level. A negative answer at step 109 indicates that the polarizer has not been adjusted through its entire range of settings, and thus the current value $P_C$ of the polarizer mode operator is to be incremented and steps 102 through 109 re-iterated. The incrementing of $P_C$ is effected at step 110, which then returns the system to step 102.

It will be appreciated that each time the polarizer mode operator value $P_C$ is incremented at step 110, the resulting output signal from the microprocessor 53 changes the DC voltage output of the polarizer driver 59 to change the setting of the polarizer 56. The adjustment range of the polarizer is limited by the saturation points of the ferrite core, but the sensitivity of the control system is determined by the size of the increments, i.e., the number of increments required to cover the full range of the polarizer 56.

If the answer at step 109 is affirmative, the system advances to step 111 where the polarizer setting is adjusted to the level represented by the polarizer mode operator value $P_L$ corresponding to the lowest noise level value $N_L$. In actual practice, instead of setting the polarizer directly to the best mode $P_L$, it is advisable to move upwardly in steps from the zero setting to the selected setting in order to avoid hysteresis effects inherent in the ferrite core of the polarizer.

We claim:

1. In a TVRO earth station having an antenna for receiving incoming satellite signals and polarizing means associated with the antenna for adjusting the relative alignment of the antenna orientation and the polarization of the incoming signals, an automatic polarization control system comprising means for producing an electrical control signal for controlling said polarizing means to adjust said relative alignment, means for detecting the noise level apart from the signal level in the satellite signals received by the antenna, and means responsive to the detected noise level for adjusting said control signal, and thereby adjusting said polarizing means, to minimize the detected noise level.

2. The TVRO earth station of claim 1 wherein said polarizing means comprises a ferrite polarizer which adjusts the polarization of the incoming satellite signals relative to the antenna orientation to selectively determine which polarization of the incoming signals is actually received by the antenna.

3. The TVRO earth station of claim 1 wherein said antenna includes a feed horn containing a probe, and said polarizing means comprises means for rotating said probe to selectively determine which polarization of the incoming signals is actually received by the antenna.

4. The TVRO earth station of claim 1 which includes a tuner for selecting the signals received from a particular satellite transponder, and a demodulator for demodulating the selected signals, and wherein said noise-detecting means receives the video output from the demodulator for detecting the noise level in the signals received from the selected transponder.

5. The TVRO earth station of claim 1 which includes means for determining the minimum detected noise level for a selected channel and storing a value representing the level of said control signal corresponding to the minimum detected noise level.

6. The TVRO earth station of claim 5 which includes means responsive to each channel selection for adjusting said control signal to a level corresponding to said stored value.

7. The TVRO earth station of claim 1 which includes means for adjusting said control signal through a predetermined range of values, and thereby adjusting said polarizing means through a predetermined range of settings.

8. In a TVRO earth station having an antenna for receiving incoming satellite signals and polarizing means associated with the antenna for adjusting the relative alignment of the antenna orientation and the polarization of the incoming signals, an automatic polarization control system comprising means for producing an electrical control signal for controlling said polarizing means to adjust said relative alignment, means for detecting the noise level apart from the signal level in the satellite signals received by the antenna, means for adjusting said control signal through a predetermined range of values, and thereby adjusting said polarizing means through a predetermined range of settings, and means for determining the minimum noise level detected during the adjustments of said control signal and storing the control signal value corresponding to said minimum noise level.

9. The TVRO earth station of claim 8 wherein said polarizing means comprises a ferrite-core polarizer which adjusts the polarization of the incoming satellite signals relative to the antenna orientation to selectively determine which polarization of the incoming signals is actually received by the antenna.

10. The TVRO earth station of claim 8 wherein said antenna includes a feed horn containing a probe, and said polarizing means comprises means for rotating said probe to selectively determine which polarization of the incoming signals is actually received by the antenna.

11. The TVRO earth station of claim 8 which includes a tuner for selecting the signals received from a particular satellite transponder, and a demodulator for demodulating the selected signals, and wherein said noise-detecting means receives the video output from the demodulator for detecting the noise level in the signals received from the selected transponder.

12. The TVRO earth station of claim 8 which includes means for determining the minimum detected noise level for a selected channel and storing a value representing the level of said control signal corresponding to the minimum detected noise level.

13. The TVRO earth station of claim 12 which includes means responsive to each channel selection for adjusting said control signal to a level corresponding to said stored value.

14. The TVRO earth station of claim 1 which includes a demodulator for receiving the incoming satellite signals and producing a video baseband signal which is supplied to said noise-level-detecting means, and said noise-level-detecting means detects the noise level at a frequency above that of the video information in said baseband signal.

* * * * *